US007180391B2

(12) United States Patent
Ala-Kojola

(10) Patent No.: US 7,180,391 B2
(45) Date of Patent: Feb. 20, 2007

(54) RESONATOR FILTER

(75) Inventor: Jouni Ala-Kojola, Kempele (FI)

(73) Assignee: Filtronic Comtek Oy, Kempele (FI)

( * ) Notice: Subject to any disclaimer, the term of this patent is extended or adjusted under 35 U.S.C. 154(b) by 0 days.

(21) Appl. No.: 11/132,688

(22) Filed: May 18, 2005

(65) Prior Publication Data

US 2005/0212623 A1 Sep. 29, 2005

Related U.S. Application Data

(63) Continuation of application No. PCT/FI04/00152, filed on Mar. 17, 2004.

(30) Foreign Application Priority Data

Mar. 18, 2003 (FI) ..... 20030402

(51) Int. Cl.
*H01P 1/205* (2006.01)

(52) U.S. Cl. ..... 333/207; 333/134

(58) Field of Classification Search ..... 333/202, 333/235, 207, 203, 134, 224, 206
See application file for complete search history.

(56) References Cited

U.S. PATENT DOCUMENTS

| | | | | |
|---|---|---|---|---|
| 2,519,524 A | * | 8/1950 | Wheeler | 333/202 |
| 3,693,115 A | * | 9/1972 | Edson | 333/203 |
| 5,352,997 A | | 10/1994 | Sarkka | |
| 5,612,655 A | | 3/1997 | Stronks et al. | |
| 5,850,169 A | | 12/1998 | Hietala | |
| 5,949,302 A | | 9/1999 | Sarkka | |

FOREIGN PATENT DOCUMENTS

| | | | |
|---|---|---|---|
| DE | 2412759 A | * | 9/1975 |
| FI | 1169747 T3 | | 10/2002 |
| JP | 55003267 | | 1/1980 |
| JP | 58111404 | | 7/1983 |
| JP | 62123801 | | 6/1987 |
| WO | WO-96/11508 A1 | | 10/1995 |
| WO | WO-99/30383 A2 | | 6/1999 |
| WO | WO-00/64001 A1 | | 10/2000 |

* cited by examiner

*Primary Examiner*—Seungsook Ham
(74) *Attorney, Agent, or Firm*—Darby & Darby

(57) ABSTRACT

The invention relates to a tunable resonator filter. In each resonator cavity of the filter there is a movable dielectric tuning element (728; 748) to adjust the resonator's natural frequency. The tuning elements are advantageously arranged to be moved by a common control implemented by a rod (708) joining them together, to shift the filter's band through equal displacements of the natural frequencies of the resonators. When the tuning element is moved horizontally sidewards from the resonator (710; 720; 730; 740; 750; 760) axis, the electrical length and natural frequency of the resonator change. In that case, when sub-bands are used it is not necessary to tune the filters separately for each sub-band in the stage of manufacture, as the sub-band can be chosen when the filter is put into use. The tuning elements can be movable also in each resonator separately, to implement the basic tuning in connection with the manufacture of the filter. The basic tuning can be automated, in other words it can be made without inconvenient handwork.

19 Claims, 8 Drawing Sheets

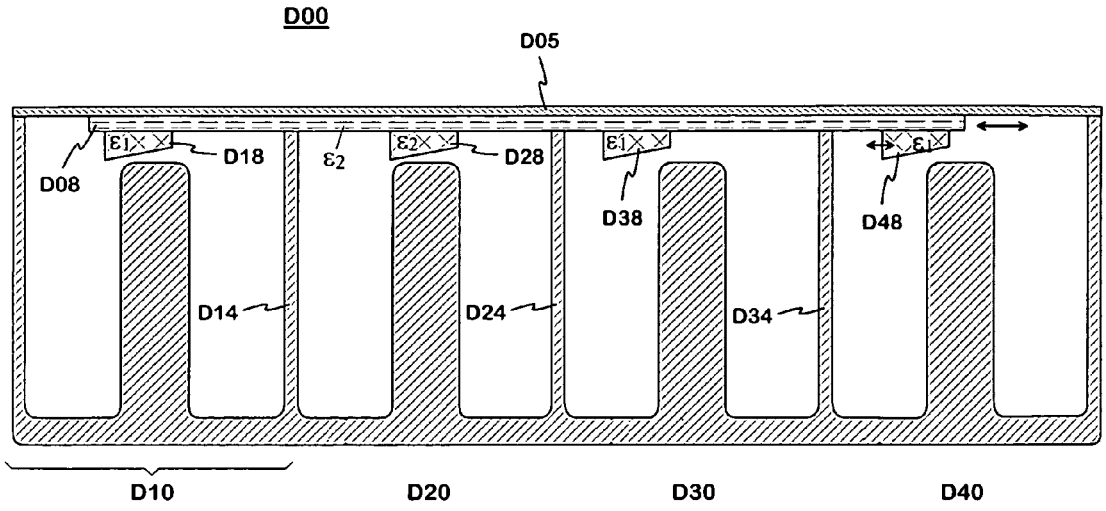
Fig. 13
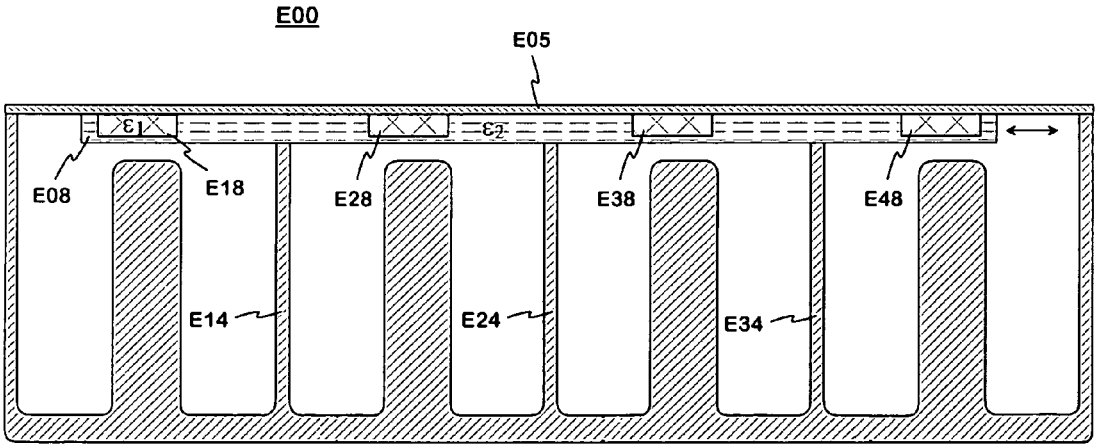
Fig. 14
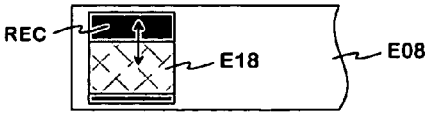

RESONATOR FILTER

CROSS REFERENCE TO PRIOR APPLICATION

This application is a continuation of International Patent Application Ser. No. PCT/FI2004/000152, filed Mar. 17, 2004, which claims priority of Finnish Application No. 20030402, filed Mar. 18, 2003. PCT/FI2004/000152 published in English on Sep. 30, 2004 as WO 2004/084340 A1.

The invention relates to a filter consisting of resonators, which filter can be tuned after its manufacture. A typical application of the invention is an antenna filter in a base station.

BACKGROUND OF THE INVENTION

In order to obtain a frequency response of a resonator filter, which meets the specifications, it is necessary to have right coupling strengths between the resonators, and a certain resonator frequency, or natural frequency for each resonator. In series production the variation of the natural frequencies of resonators made in the same way is usually too large to keep all natural frequencies at a sufficiently right value. Therefore each resonator in each filter must be tuned individually. Here such tuning is called basic tuning. If the filter is intended to be used as a part in a system, where the transmitting and receiving bands are divided into sub-bands, then the width of the passband of the filter must equal the width of a sub-band. Further the passband of the filter must be located at the desired sub-band. An adjusting of the natural frequencies of the resonators is sufficient to shift the passband; it is not necessary to change the couplings between the resonators.

Previously it is known the use of tuning screws in the adjusting of the natural frequency of a resonator. The lid of e.g. coaxial resonator is equipped with a metal screw at the inner conductor of the resonator. When the screw is turned, the capacitance between the inner conductor and the lid changes, in which case also the natural frequency of the resonator changes. A disadvantage in the use of tuning screws is that in a multi-resonator filter it may be necessary to manually turn the screws in many stages to obtain the desired frequency response. Thus the tuning is time consuming and relatively expensive. The screw accessories increase the number of components in the filter, and the threaded screw holes mean an increased number of work steps. These facts will raise the manufacturing costs on their part. In addition the electrical contact in the threads may deteriorate in the course of time, which results in tuning drift and in increased losses in the resonator. Moreover, there is a risk of electric breakdown in high-power filters of the transmitting end if the point of the screw is close to the end of the inner conductor.

Regarding a coaxial resonator, the capacitance between its inner conductor and the surrounding conductive parts can be changed by means of bendable elements, too. In a known structure there is a planar extension at the end of the inner conductor, in parallel with the lid. At the edges of the extension there is at least one projection parallel with a side wall, which functions as a tuning element. By bending the tuning element said capacitance and, at the same time, the natural frequency of the resonator will be changed. A disadvantage of that kind of solution is that in a multi-resonator filter it can be necessary to manually bend the tuning elements in several stages to obtain the desired frequency response. The filter's lid must be opened and closed for each tuning stage. Thus also in this case the tuning is time-consuming and relatively expensive. This is emphasized by the use of sub-bands, as the filters must be tuned for each sub-band during the manufacturing.

FIG. 1 presents a tuning way of resonator filter using a dielectric tuning element, the way being known from the publication JP 62123801. In the figure there is a longitudinal section of one coaxial resonator 110 of the filter, the resonator comprising a bottom 111, an inner conductor 112–113, an outer conductor 114 and a lid 115. The outer conductor surrounds the inner conductor over its whole length, as normally. In addition, the resonator comprises in this example a cylindrical dielectric block having an axial, vertical hole. The block has been coated by conductive material apart from its upper surface. The inner conductor consists of that coating material 112 and a cylindrical conductor 113 having a firm contact with the wall of the hole. The widened upper end of the cylindrical conductor extends above the upper surface of the dielectric block. The bottom 111 shorts the transmission line formed by the inner and outer conductors at its lower end. At the upper end of the structure the inner conductor does not extend to the conductive lid, so the transmission line is open at the top. A result of this is that the structure functions as a quarter wave resonator.

For the tuning of the resonator 110 there is a conductive screw 117 in its lid 115. A cylindrical dielectric tuning element 118 has been attached on the lower surface of the screw, the tuning element being made of material, which has relatively high dielectricity, such as ceramics. That dielectric tuning element is located in the resonator cavity above the inner conductor of the resonator, at certain distance d from the upper surface of the inner conductor. When the screw 117 is turned deeper, for instance, the distance d is decreased. In that case the effective dielectricity between the inner conductor and the lid increases, because the ceramics fills greater part of the space therebetween, in the proportion. The capacitance between the inner conductor 116 and the lid is increased for the increase of the dielectricity and for the approach of the conductive screw, on the other hand. The increase of the capacitance results in increase of the resonator capacitance results in increase of the resonator electric length and lowering in the resonator natural frequency. Disadvantages of this solution, too, are that in a multi-resonator filter it may be necessary to manually turn the screws in many stages to obtain the desired frequency response, and that the electrical contact in the screw joint may deteriorate in the course of time.

FIGS. 2*a,b* present another example of a known resonator filter, for tuning of which a dielectric tuning element is used. In FIG. 2*a* there is a longitudinal section of the filter 200 and in FIG. 2*b* it is seen from above the lid 205 cut open. The filter comprises a conductive housing formed by a bottom, outer walls and the lid, the space of the housing being divided into the resonator cavities by conductive partition walls. In each cavity there is, to reduce the resonator size, a fixed cylindrical dielectric block, such as the dielectric block 216 of the first resonator, visible in the figure. The bases of the cylinder are parallel with the bottom and the lid of the resonator, and the block has been raised over the resonator bottom 211 by a dielectric support piece SU. The support piece has substantially lower dielectricity than the dielectric block 216. The dielectric block has been dimensioned so that a transverse electric wave $TE_{01}$ is excited in it at the operating frequencies of the filter. The resonators then are half wave cavity resonators by type.

For the tuning of the first resonator of the filter 200, in the resonator's lid there is a screw 217 made of a dielectric material such as a plastic. A cylindrical, e.g. ceramic tuning element 218 has been attached on the lower surface of the screw. That tuning element is located in the resonator cavity above the dielectric block 216, at certain distance from the upper surface of the block. When the screw 217 is turned e.g. deeper the tuning element 218 approaches the dielectric block 216. In that case the electric size of the dielectric block increases, and the natural frequency of the block and the whole resonator lowers. Disadvantages of this solution, too, are that in a multi-resonator filter it may be necessary to manually turn the screws in many stages to obtain the desired frequency response.

SUMMARY OF THE INVENTION

The object of the invention is to reduce the mentioned disadvantages relating to prior art. A resonator filter according to the invention is characterised in what is presented in the independent claims 1 and 25. The other claims present some advantageous embodiments of the invention.

The basic idea of the invention is as follows: In each resonator cavity of a resonator filter there is a movable dielectric tuning element to adjust the resonator's natural frequency. The tuning elements are advantageously arranged to be moved by a common control, to shift the filter's band through equal displacements of the natural frequencies of the resonators. When the tuning element is moved e.g. horizontally sidewards from the resonator axis, the electrical length and natural frequency of the resonator change. The tuning elements can be movable in each resonator separately, too, to implement the basic tuning of a filter.

An advantage of the invention is that when sub-bands are used it is not necessary to tune the filters separately for each sub-band in the stage of manufacture, as the sub-band can be chosen when the filter is put into use, by a single tuning motion the common control being applied. Another advantage of the invention is that the tuning mechanism consists of few parts, even only of one object, which brings savings in production costs. A further advantage of the invention is that the basic tuning of the filter can be automated, in other words it can be made without inconvenient handwork. Then an actuator and a device measuring the response of the filter are programmed to cooperate so that the tuning elements are moved programmably until an optimal response is obtained. A further advantage of the invention is that the tuning does not change in the course of time, as there are no metallic junctions between the tuning element and the rest of the structure.

BRIEF DESCRIPTION OF THE DRAWINGS

The invention is described in detail below. The description refers to the enclosed drawings, in which FIG. 13 shows an example of a filter, for which it can be done both the basic tuning and the common tuning, according to the invention, FIG. 14 shows another example of a filter, for which it can be done both the basic tuning and the common tuning, according to the invention,

DETAILED DESCRIPTION OF THE INVENTION

Figure 1:
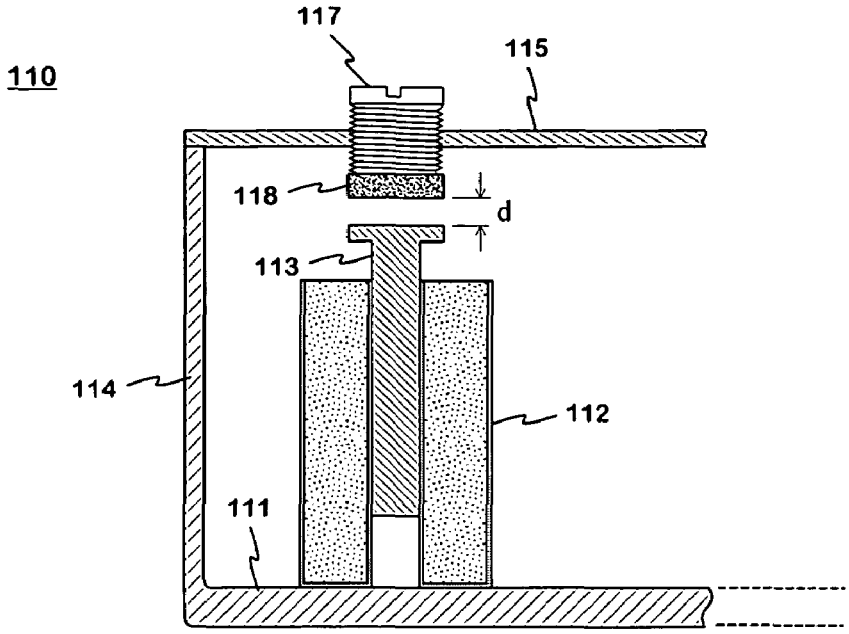
Fig. 1 PRIOR ART
FIG. 1 shows an example of a prior art tunable filter, FIGS. 2*a,b* show another example of a prior art tunable filter, FIGS. 3*a,b* show an example of a tunable filter according to the invention.
Figure 2A:
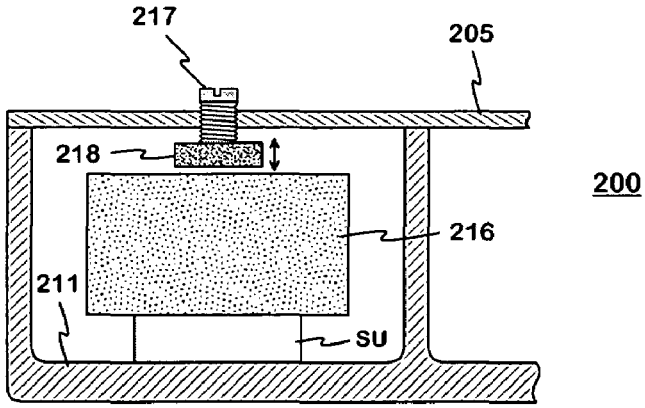
Fig. 2a PRIOR ART
Figure 2B:
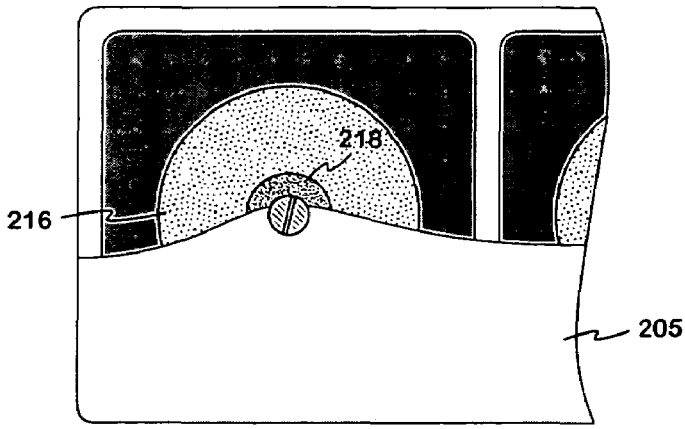
Fig. 2b PRIOR ART

FIGS. 1 and 2 were described already in connection with the description of prior art.

Figure 3A:
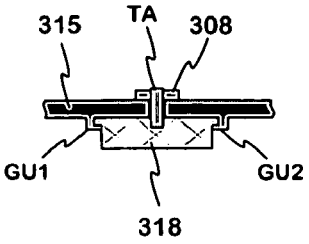
Figure 3A:
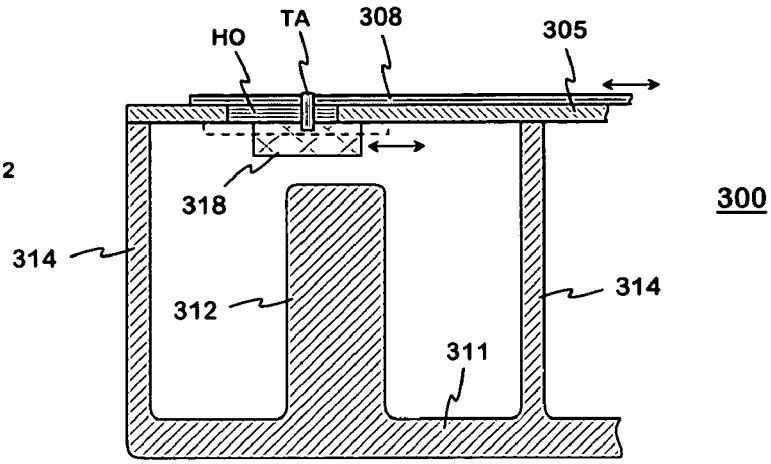
Figure 3B:
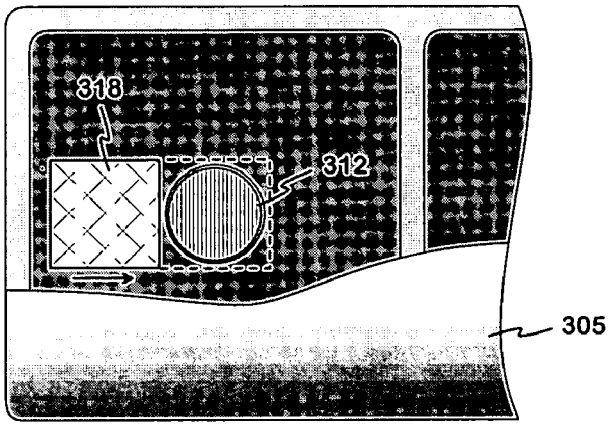

FIGS. 3*a* and 3*b* show an example of a tunable filter according to the invention. The filter 300 consists of quarter wave coaxial resonators, from which the first resonator and partly the second resonator are seen in the figure. FIG. 3*a* shows the structure in a longitudal section from one side. The first resonator has a bottom 311, an inner conductor 312, an outer conductor 314 and a lid 305. The tuning element 318 is a right-angled prismatic dielectric piece located at the open end of the resonator. In the vertical direction it extends from the lid about halfway to the top of the inner conductor 312. In this example the tuning element is attached to the lower surface of the resonator's lid with the aid of the guide rails GU1 and GU2 shown in the accompanying figure so that it can be moved back and forth in the horizontal plane. In order to be able to move it manually from the outside the lid 305 has an elongated hole HO. In the hole there is a vertical tap TA, which extends at the lower end into the tuning element and at the upper end into a control rod 308 being located on the filter's lid. That rod is linked in the same way with the tuning elements of the other resonators, too. Thus the whole filter can be tuned in one go by moving the rod.

In FIG. 3*b* the first resonator is seen from above with the lid cut open. When the tuning element 318 is at one end of the adjusting range, at the right end in FIG. 3*b*, it is located at the centre of the resonator, seen from above. In this example the size of the tuning element is such that it wholly covers the top surface of the inner conductor 312. When the tuning element 318 is at the other end of the adjusting range, at the left end in FIG. 3*b*, then seen from above it is located on one side so that the whole top surface of the inner conductor is visible. When the tuning element is at the right end of its adjusting range the effective dielectric factor in the upper part of the resonator cavity has a maximum, because in that case the dielectric piece 318 is located at a point where the strength of the electric field has a maximum while the structure resonates. Further, when the effective dielectric factor is at its maximum the capacitance between the top of the inner conductor and the surrounding conductor surfaces is at its maximum, the electric length of the resonator has a maximum, and the natural frequency has a minimum. Correspondingly, when the tuning element 318 is at the left end of its adjusting range the natural frequency of the resonator is at its maximum.

The tuning element can be e.g. round instead of rectangular, seen from above. Its motion direction can be, seen from above, e.g. from the centre of the resonator towards some of the corners or from the side of the inner conductor towards a corner.

Figure 4:
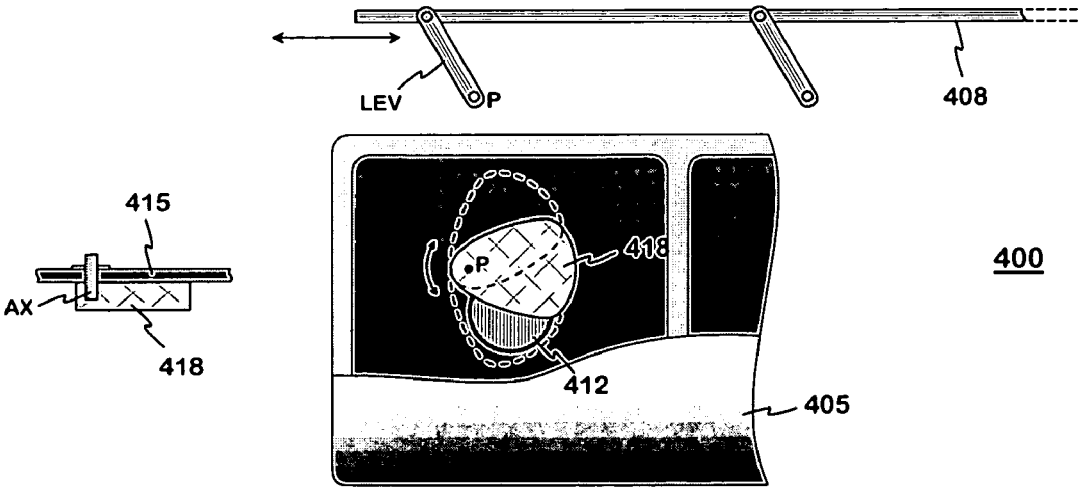
FIG. 4 shows another example of a tunable filter according to the invention.

FIG. 4 shows another example of a coaxial resonator filter according to the invention. In the figure one resonator of the filter 300 is seen whole, from above with the lid cut open. Its basic structure is similar to that of the FIGS. 3*a*, 3*b*. Also in this case the tuning element 418 is a movable dielectric piece at the open end of the resonator. The difference to the solution of FIGS. 3*a*, 3*b* is that instead of a linear motion the tuning element 418 is now moved by rotating it in the horizontal plane. To this end the tuning element is provided with an axis to the resonator lid 415, at a point P close to its end. Seen from the point P of rotation towards the opposite end the tuning element has a broadening form, as seen in the horizontal plane. The axis of rotation is slightly outside the inner conductor 412. When the tuning element 418 is at one end of the adjusting range, at the clockwise end as seen in FIG. 4, its broad end covers the upper surface of the inner conductor, as seen from above. When the tuning element 418 is at other end of the adjusting range, at the anticlockwise end as seen in FIG. 4, then the whole tuning element is located on one side of the inner conductor, as seen from above. Due to reason mentioned before the natural frequency of the resonator reaches its minimum when the tuning element has been turned clockwise so that it is above the inner conductor, and the natural frequency increases as the tuning element is turned anticlockwise.

The axis AX, going through the lid, is seen in the small accompanying figure. At its top the axis is fixedly fastened to an arm LEV, the other end of which is fastened by a shaft locking to a control rod 408 located on the lid. That rod is connected in the same way to the tuning elements of the other resonators, too. Thus all tuning elements can be turned in one go by moving the rod. Instead of the arm structure shown in the figure, for instance a small cog would be at the top of the axes, and as the control rod would be a rack bar fit to the cogs.

When the common tuning is not used or the control rod with the arms has not yet mounted, the tuning element of a resonator can be turned, for the basic tuning, by a tool fit to the shape of the axis AX.

Figure 5A:
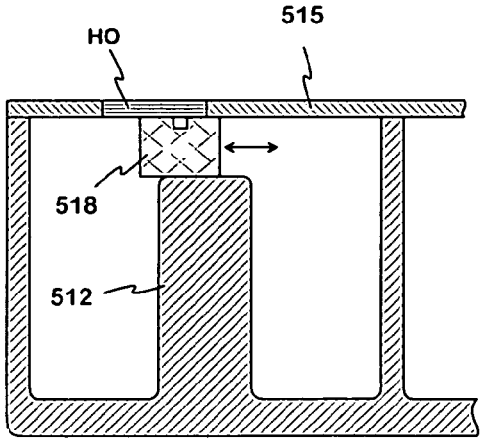
FIGS. 5*a–d* show examples of tuning elements according to the invention.
Figure 5B:
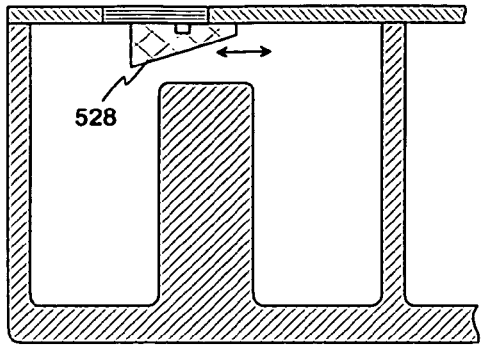
Figure 5C:
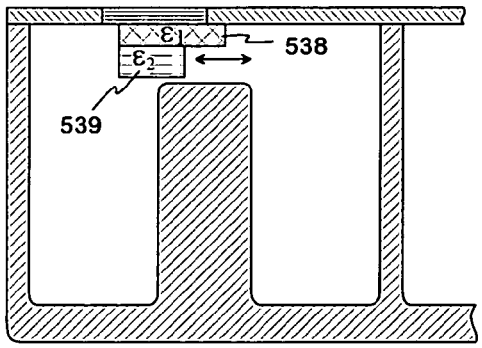
Figure 5D:
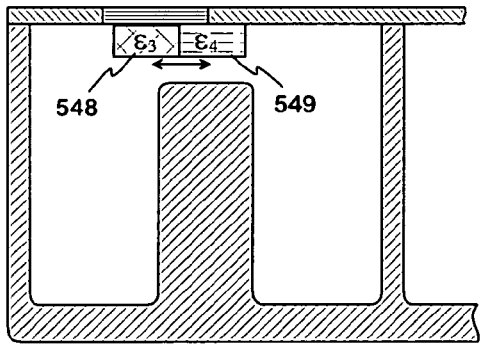

FIGS. 5*a* to 5*d* show other examples of a tuning element according to the invention. In the examples the resonators are coaxial quarter wave resonators. In FIG. 5*a* the dielectric tuning element 518 extends from the lower surface of the lid 515 to the top surface of the inner conductor 512. Compared with FIG. 3*a* the tuning element has a greater effect on the electric length of the resonator, and the adjusting range of the natural-frequency is wider, if the materials are the same. In FIG. 5*b* the tuning element 528 is wedge-like, seen from the side in a direction perpendicular to its motion direction. Then the resonator's natural frequency as a function of the motion of the tuning element changes in a manner different from that of the structure according to FIG. 3*a*. It is for instance possible to obtain a more linear change of the natural frequency. In FIG. 5*c* the resonator's tuning element has two parts on top of each other. The dielectric constant $\epsilon_1$ of the first part 538 does not equal the dielectric constant $\epsilon_2$ of the second part 539. The resonator's tuning element in FIG. 5*d* has also two parts, with different dielectric constants. In this case the first part 548 and the second part 549 of the tuning element are located side by side, as seen from the side in a direction perpendicular to its motion direction. By suitably varying the dielectricity within the tuning element it is possible to vary the width of the adjusting range and the sensitivity of the tuning in a desired way.

Figure 6:
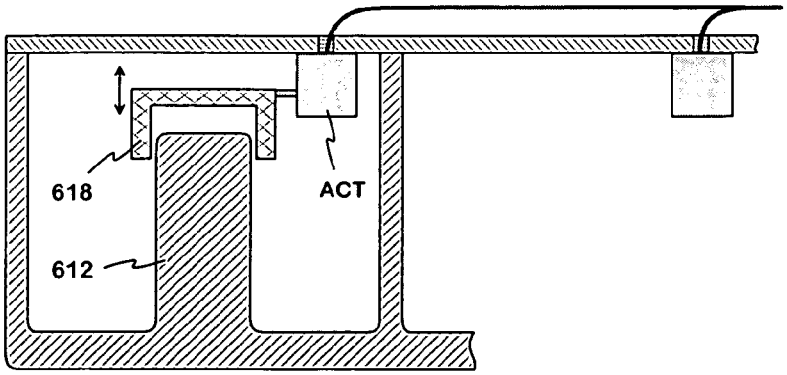
FIG. 6 shows an example of a tuning element according to the invention and of moving of the tuning element.

FIG. 6 shows a further example of a tuning element according to the invention and of the tuning. The tuning element 618 has bowl-like form, and it encloses the top of the inner conductor 612. Now the tuning element can be moved back and forth in the vertical direction. For moving the resonator has in this example an internal actuator ACT, to vertically movable shaft of which the tuning element has been attached. The actuator is arranged to receive its control electrically from the outside of the resonator. By an electric control first the basic tuning of the filter can be performed in each resonator separately, and later the common tuning to place the band. In the latter tuning all resonators get the same control, of course. The electric control can be implemented by a cable or a radio way.

Figure 7A:
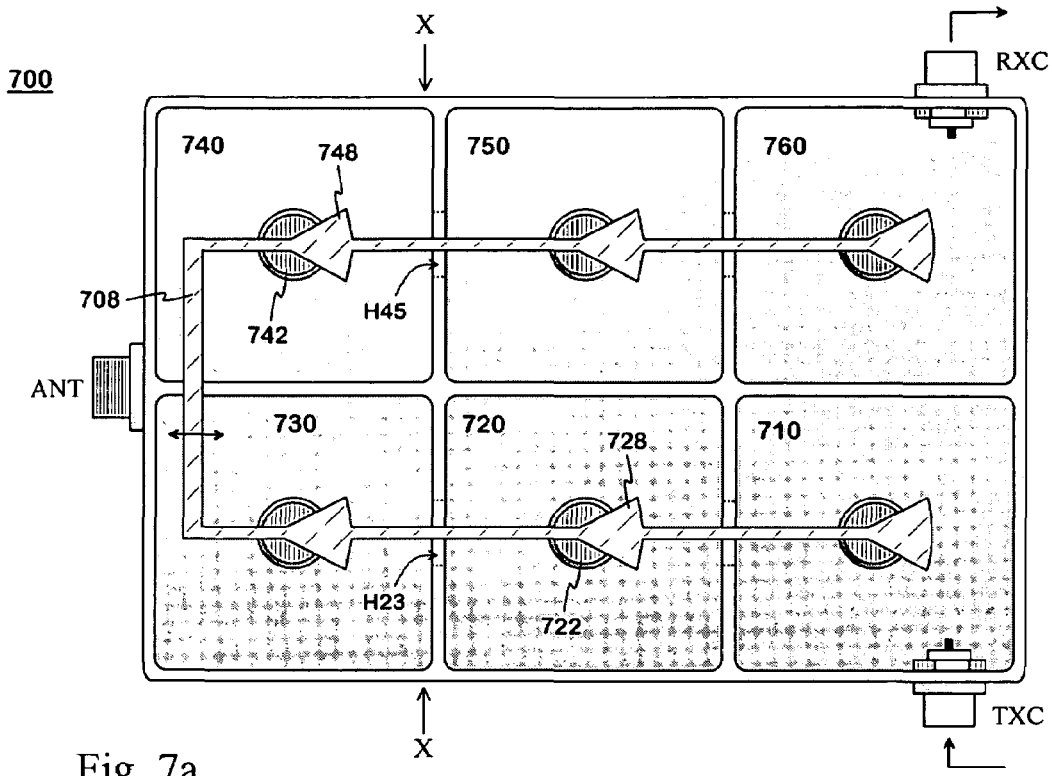
FIGS. 7*a–c* show a further example of a filter according to the invention.
Figure 7B:
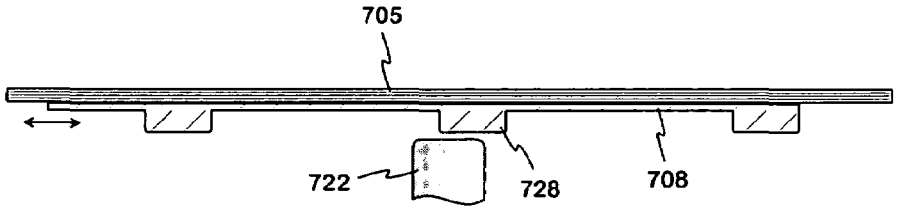
Figure 7C:
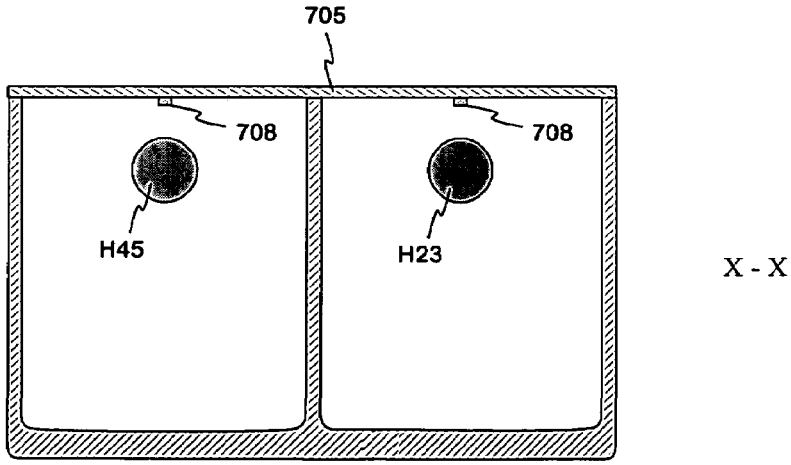

FIGS. 7*a* to 7*c* show an example of a filter, the passband of which can be shifted according to the invention. The filter of the example is a duplex filter 700 with six resonators. In FIG. 7*a* the structure is seen from above, with the lid removed. The resonators are in two rows, three resonators in each row. The first 710, the second 720 and the third 730 resonator form the receiving side of a duplex filter, and the fourth 740, the fifth 750 and the sixth 760 resonator form the transmitting side of the duplex filter. The third and the fourth resonators are located side by side in the 2×3 formation, and both of them have a coupling to the antenna connector ANT. The sixth resonator has a coupling to the receiving connector RXC and the first resonator to the transmitting connector TXC. The structure comprises further a unitary dielectric tuning body, which consists of resonator-dedicated tuning elements, such as the tuning element 728 of the second resonator, and of a rod part 708. The rod part has a shape as a rectangular U; it has a first section extending from the first resonator to the third resonator, a transversal section extending from the third resonator to the fourth resonator and a third section extending from the fourth resonator to the sixth resonator. Each resonator-dedicated tuning element is an extension of the rod part of the tuning body, in a way. The unitary tuning body can be moved in the horizontal plane, back and forth in the longitudinal direction of the filter, so that the tuning elements are moved to a position above the inner conductors of the resonators, or away from a position above the inner conductors. In that case, on the basis of what was described above both the transmitting and receiving bands of the duplex filter will be shifted simultaneously. The lid of the filter has a slot to enable motion of the tuning body, the length of the slot corresponding to the width of the adjusting range. Alternatively the tuning body will be moved through the end of the filter housing at the third and fourth resonators. Then a relatively small hole in the end wall is sufficient for the tuning.

FIG. 7*b* shows the lid 705 and the tuning body seen from the side of the filter's 700 transmitting side. In the example of the figure the extensions in the tuning body, or the tuning elements, extend deeper into the resonators than the rod part 708 interconnecting the tuning elements. For instance the tuning element 728 of the second resonator extends close to the top of the second inner conductor 722 drawn in the figure. Naturally the tuning body can be also monotonous in the horizontal direction.

FIG. 7*c* shows a cross-section X—X of the filter 700 at those partition walls, which separate the first and second resonators and the fourth and fifth resonators. In the upper part of the former partition wall, immediately below the filter's lid 705 there is a small notch, through which the rod part 708 travels from the second tuning element to the third tuning element. Correspondingly there is a notch in the partition wall separating the fourth and fifth resonators, through which the rod part 708 travels from the fourth tuning element to the fifth tuning element. FIG. 7*c* shows also a coupling hole H23 between the second and third resonators, and a coupling hole H45 between the fourth and fifth resonators. These holes are marked also in FIG. 7*a* by dotted lines.

Figure 8:
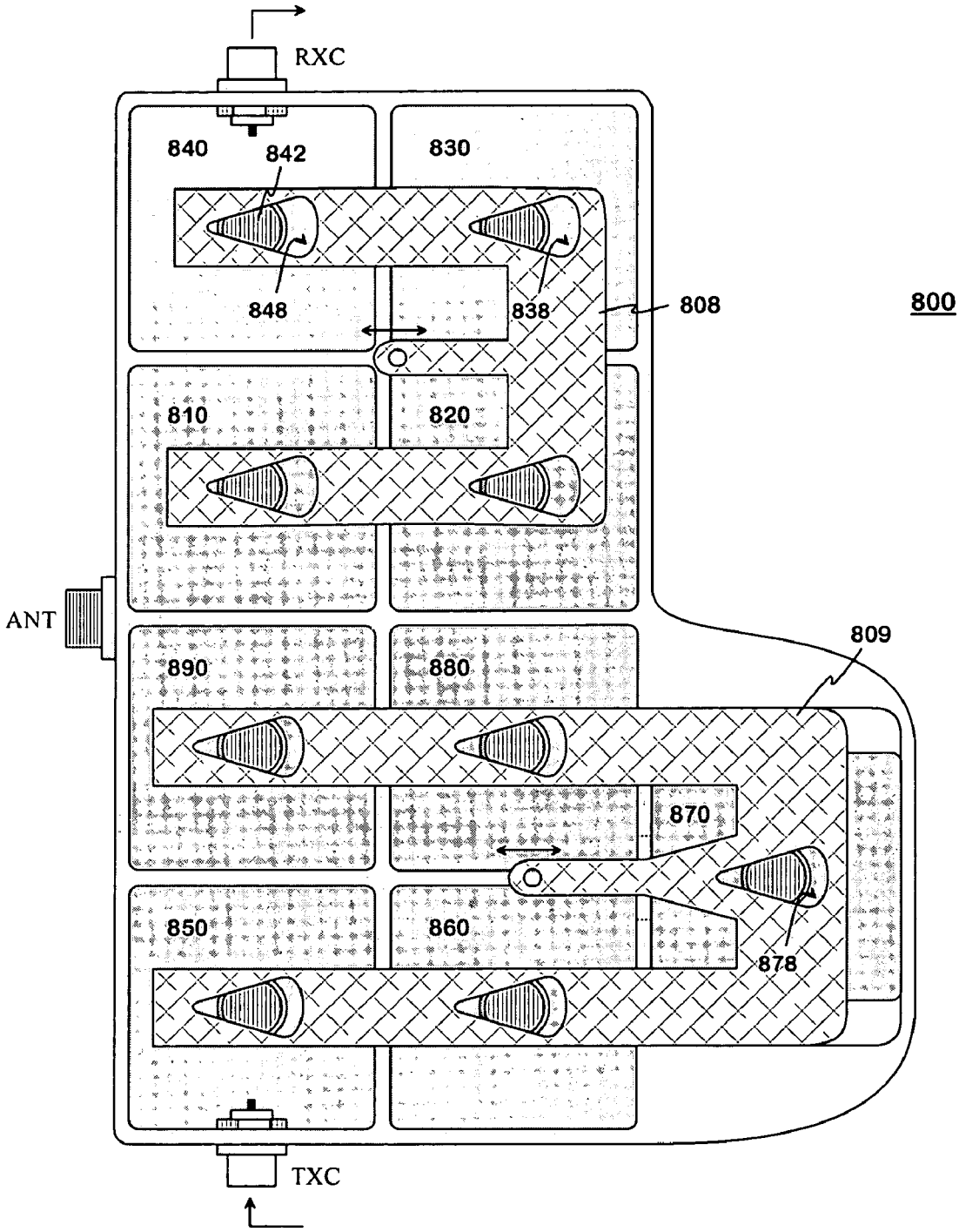
FIG. 8 shows a further example of a filter according to the invention.

FIG. 8 shows another example of a filter, the passband of which can be shifted according to the invention. The filter 800 is presented from above the lid removed. It is a duplex filter like the filter 700 in FIG. 7. The first 810, the second 820, the third 830 and the fourth 840 resonators are located in a square, and they form the receiving side of the duplex filter. The receiving filter comprises a first tuning body 808 in a form resembling a rectangular letter U, the first tuning body being an unitary and plate-like dielectric object. It has a first section extending from the first resonator to the second resonator, a transversal second section extending from the second resonator to the third resonator, and a third section extending from the third resonator to the fourth resonator. A projection directed toward the centre of the U-form joins to the second section in the same plane, an external tool being fit into this projection during the tuning of the filter. The tuning body 808 has at each resonator a hole, which corresponds to an individual tuning element. For instance, in the space of the third resonator the tuning body has a hole 838, and in the space of the fourth resonator it has a hole 848. A part of the top surface of the inner conductor 846 of the fourth resonator is seen through the hole 848. At the other three resonators the situation is similar. The tuning body 808 can be moved back and forth in the horizontal plane, so that its holes move to a position above the inner conductors of the resonators, or away from the position above the inner conductors.

Seen in the direction of motion one end of the holes is clearly wider than the other end. At the one end of the adjusting range the wide ends are above the inner conductors, and at the opposite end of the adjusting range the narrow ends of the holes are above the inner conductors. The effective dielectricity in the upper part of the resonators will increase when moving from the former state to the later, whereby the natural frequencies will be reduced, and the passband will shift downwards.

In the duplex filter 800 the fifth 850, the sixth 860, the seventh 870, the eighth 880 and the ninth 890 resonators form the transmitting filter. The fifth, sixth, eighth and the ninth resonators are located in a square, and the seventh is on the side of the square, in the propagation direction of the signal between the sixth and the eighth resonators. The location of the transmitting filter's passband is changed by a second tuning body 809, which is similar to the first tuning body 808. The only differences are that the second tuning body is longer due to the higher number of resonators, and its transversal section has a hole 878 for adjusting the natural frequency of the seventh resonator.

Figure 9:
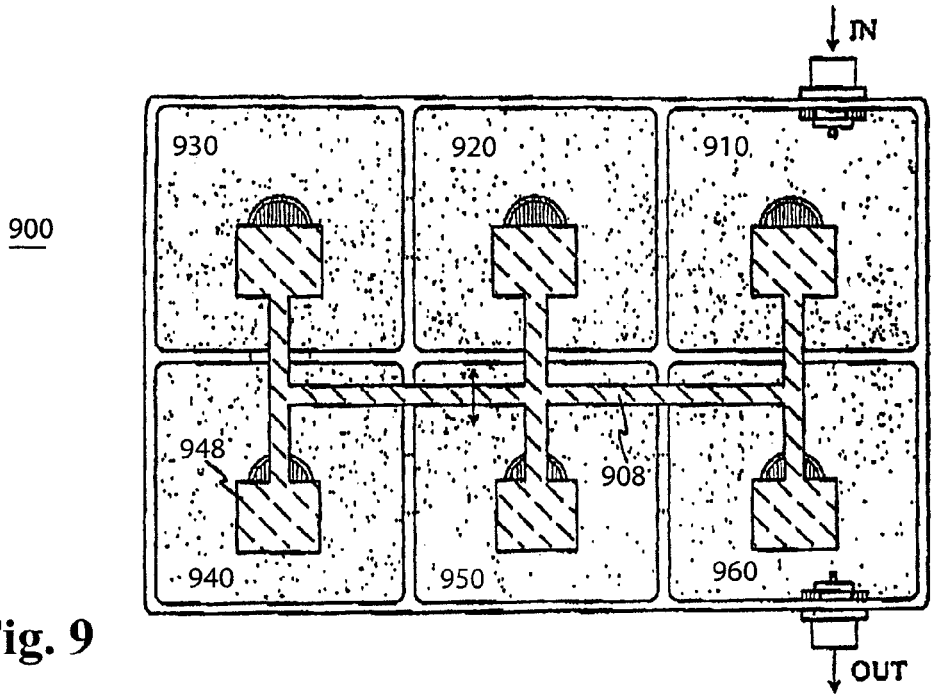
FIG. 9 shows a further example of a filter according to the invention, FIGS. 10*a,b* show a further example of a filter according to the invention, FIGS. 11*a,b* show a further example of a filter according to the invention.

FIG. 9 shows a further example of a filter, the passband of which can be shifted according to the invention. The filter 900 has six resonators 910 to 960 in a similar 3×2 matrix as in FIG. 7*a*, as seen from above. The unitary tuning body has a longitudinal rod part, from which there is a transversal branch to each resonator. The end of each branch carries an extension a tuning element, such as the tuning element 948 in the fourth resonator. The tuning body can be moved in the horizontal plane, back and forth in the transversal direction, so that the tuning elements are moved to a position above the inner conductors of the resonators, or away from the position above the inner conductors. In FIG. 9 the tuning body is in an intermediate position where the top surfaces of the inner conductors of the resonators are seen about half below the tuning elements. The motion of the tuning body can be arranged also vertical by direction, in principle, in which case the height of the holes in the partition walls for the transversal branches must correspond to the width of the adjusting range.

Figure 10A:
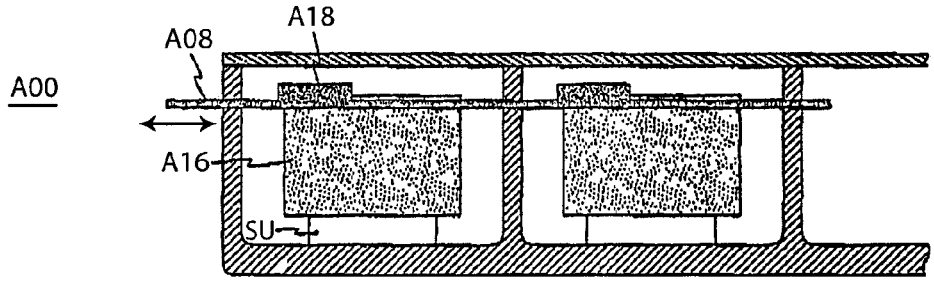

FIGS. 10*a, b* show a further example of a filter, the passband of which can be shifted according to the invention. The resonators of the filter A00 are similar dielectric cavity resonators to that of FIG. 2, in regard to the basic structure. So there is, in each cavity, a fixed cylindrical dielectric block, such as the dielectric block A16 in the resonator A10, separated from the bottom and other walls of the resonator by means of a support piece SU. The support piece has substantially lower dielectricity than the dielectric block A16, for which reason it has only an minor influence on the characteristics of the resonator. In the upper base of each dielectric block there is a rectangular recess having constant breath and the same direction as the longitudinal direction of the filter. In that kind of recess there is a rectangular tuning element, such as the tuning element A18 in the resonator A10, having almost same breath as the recess. The tuning elements have been connected to each other by a rod part A08 resulting in an unitary tuning body. The rod part goes through the holes in the partition walls of the resonators, and the end of the rod part sticks out through the hole in the end wall of the filter. When the tuning body is moved using the end of the rod, the tuning elements slide in the recesses of the dielectric blocks. In that case the natural frequencies of the resonators change by the same amount and the filter's passband will be shifted.

Said recesses of the dielectric blocks are not necessary, of course. The upper bases then can be also even, in which case the tuning body is moved along the surfaces of the upper bases or above the upper bases. In the latter case the tuning body has been supported only to the holes in the partition walls and end wall of the filter housing. The tuning body can be located also below the dielectric blocks, as well, if the dielectric blocks have been attached to the resonator walls by support pieces. The shape of the tuning elements, seen from above, can be e.g. triangular instead of rectangular, to work up the adjusting effect. Regardless of the shape of the broadening, the tuning elements can be also as thick as the rod part of the tuning body, in the vertical direction.

Figure 10B:
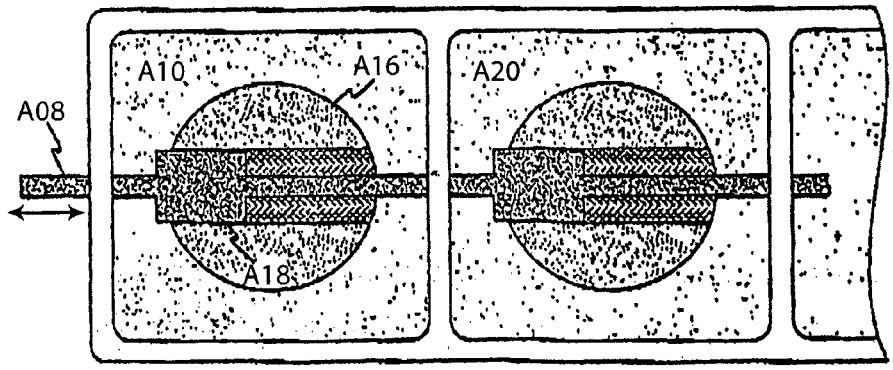
Figure 11A:
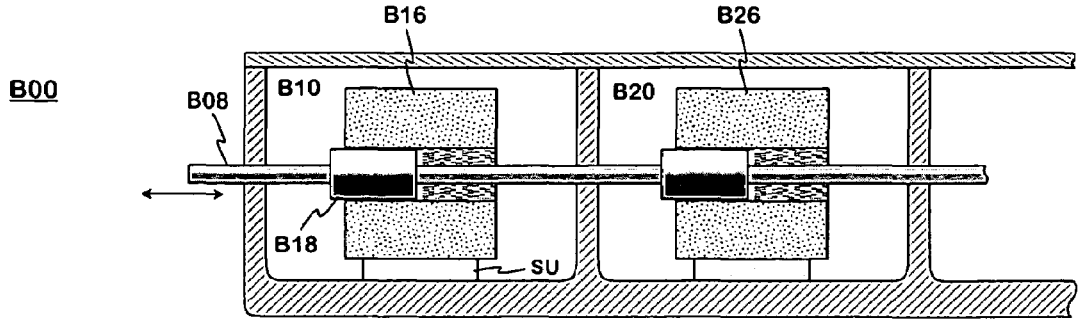
Figure 11B:
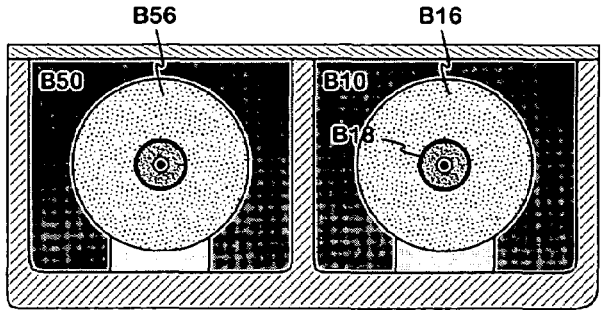

FIGS. 11*a, b* show a further example of a filter, the passband of which can be shifted according to the invention. The resonators of the filter B00 are dielectric cavity resonators, as in FIG. 10. However the basic structure is different such that the axis of a fixed cylindrical dielectric block in a resonator cavity now is horizontal being united with the axes of the other dielectric blocks in the successive resonator cavities. Also in this example the dielectric block has been arranged approximately to the middle of the resonator cavity by a support piece SU having low dielectricity. Each dielectric block has an axial hole. In this kind of hole there is a cylindrical tuning element, such as the tuning element B18 of the resonator B10, the diameter of the tuning element being close to the diameter of the hole. The tuning elements have been connected to each other by a rod part B08 resulting in an unitary dielectric tuning body. The rod part goes through the holes in the partition walls of the resonators, and the end of the rod part sticks out through the hole in the end wall of the filter. When the rod is pushed or pulled at its end, the tuning elements move in the holes of the dielectric blocks. In that case the natural frequencies of the resonators change by the same amount and the filter's passband will be shifted. In FIG. 11*b* the exemplary filter B00 is seen from the side of an end as a cross section. From the figure it appears, that the resonators are in two parallel rows, the end resonators being B50 and before-mentioned B10. The tuning bodies for each of two rows can be united by a transversal rod to single enlarged tuning body. The all resonators of the filter also can be in one row, of course.

Figure 12:
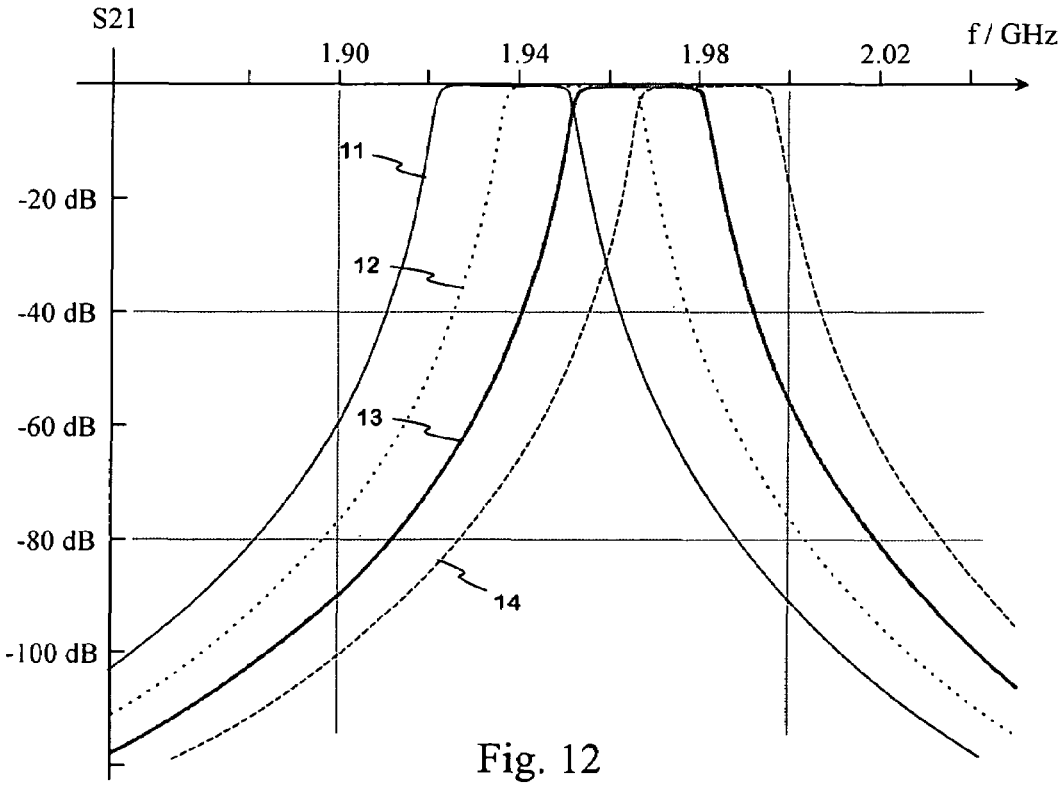
FIG. 12 shows an example of a shifting of the pass band of a filter according to the invention.

FIG. 12 shows an example of the shifting of the passband of a filter according to the invention. The figure shows the propagation coefficient S21 as a function of frequency, i.e. the amplitude response, in four situations. All four amplitude response curves have the same form. The width of the passband, appearing from the curves, is about 28 MHz. The first curve 11 shows a situation where the centre frequency of the pass band is about 1.937 GHz. The second 12, the third 13, and the fourth 14 curves show situations, where the pass band has been shifted upwards in steps of about 14 MHz. The curves has been measured from a filter similar to the transmitting part of the duplex filter in FIG. 8, its tuning body being in different positions.

FIG. 13 shows an example of a filter, in which both the basic tuning and the shifting of the passband can be implemented according to the invention. The filter D00 comprises in a row a first D10, a second D20, a third D30 and a fourth D40 coaxial resonator. The upper part of the first resonator houses a first tuning element D18, the upper part of the second resonator houses a second tuning element D28, the upper part of the third resonator houses a third tuning element D38, and the upper part of the fourth resonator houses a fourth tuning element D48. The dielectric tuning elements are attached to a dielectric control rod D08 so that they can be moved separately with regard to the control rod along a certain line segment. In the longitudinal direction of the filter the control rod extends through notches in the top edges of the filter's partition walls D14, D24, and D34 from the first resonator to the fourth resonator. The size of the notches in the partition walls corresponds to the cross-section of the control rod. Thus the control rod will be pressed against the lower surface of the filter's lid D05, however so that the control rod can be moved in its longitudinal direction. In the situation shown in FIG. 13 a suitable position has been found for each tuning element within its adjusting range, so that the shape of the filter's frequency response is optimised, and all tuning elements then have been locked in their places. Now the tuning elements and the control rod together form an unitary tuning body. When the tuning body is then moved all tuning elements move the same distance, and the location of the filter's passband is shifted on the frequency scale. Also the FIG. 13 does not show the couplings, by which the electromagnetic energy of a signal is supplied to the filter, from one resonator to the next, and out from the filter.

FIG. 14 shows another example of a filter, in which both the basic tuning and the shifting of the passband can be implemented according to the invention. The filter E00 has four resonators, also in this example. The upper part of the first resonator houses a first tuning element E18, the upper part of the second resonator houses a second tuning element E28, the upper part of the third resonator houses a third tuning element E38, and the upper part of the fourth resonator houses a fourth tuning element E48. The dielectric tuning elements are now in recesses of a dielectric tuning rod E08, so that each element can be separately moved within its own recess. The shape of the recess REC allows a motion of the tuning element in the horizontal plane, in transversal direction with regard to the longitudinal direction of the filter. The tuning shaft extends through notches in the top edges of the filter's partition walls E14, E24, and E34 from the first resonator to the fourth resonator. The size of the notches in the partition walls corresponds to the cross-section of the tuning rod. Thus the tuning rod will be pressed against the lower surface of the filter's lid E05, however so that the tuning rod can be moved in its longitudinal direction. When the basic tuning has been completed by moving the tuning elements, these are locked in their places. Then an unitary tuning body is formed. After that a location is set for the filter's passband on the frequency scale by moving the tuning body.

In FIGS. 13 and 14 the tuning elements are provided with a first dielectric constant $\epsilon_1$, and the tuning rod is provided with a second dielectric constant $\epsilon_2$. Advantageously the constant $\epsilon_1$ is greater than the constant $\epsilon_2$.

In this description and in the claims the epithets "lower", "upper" or "top", "above", "below", "horizontal", "vertical", "from one side", from above", "on top of each other" and "side by side" refer to a position of the resonators where the inner conductors and/or are vertical, and these epithets have nothing to do with the operating position of the devices.

Above filter structures based on resonators are described, which structures have movable dielectric elements for the tuning of a filter. The moving is realized with an electrically controlled regulation unit, such as a step motor or a actuator based on piezoelectricity or piezomagnetism. The shape of the tuning elements and the way to attach them can of course differ from those presented above. Neither does the invention restrict the manufacturing methods of the resonators and their tuning elements. The inventive idea is applicable in different ways within the scope of the independent claims 1 and 25.

The invention claimed is:

1. A resonator filter with coaxial resonators, comprising a conductive housing formed by a bottom, walls, and a lid, the space of the housing being divided to resonator cavities by conductive partition walls, the filter further comprising in each cavity an inner conductor, which is galvanically connected at a lower end of the inner conductor to said bottom, and a movable dielectric tuning element to change a capacitance between an upper end of the inner conductor and conductor surfaces of said housing surrounding the upper end of the inner conductor, thereby changing an electrical size and adjusting a natural frequency of the resonator, wherein the tuning elements of the resonators being arranged to be moved by a common control to shift a band of the filter through equal displacements of the natural frequencies of the resonators.

2. A filter according to claim 1, said common control being arranged by combining the tuning elements to an unitary tuning body located inside the housing.

3. A filter according to claim 1, said common control being arranged by connecting the tuning elements to a movable control rod located outside the housing.

4. A filter according to claim 2, said tuning body comprising a rod part and, as tuning elements, extensions of the rod part.

5. A filter according to claim 2, said tuning body being plate-like and having resonator-dedicated holes as tuning elements.

6. A filter according to claim 2, said tuning body comprising a control rod, and the tuning elements being supported to the control rod so that they can be moved in one direction with regard to the control rod to implement a basic tuning of the filter.

7. A filter according to claim 6, said one direction for the tuning elements being the longitudinal direction of the control rod.

8. A filter according to claim 6, said one direction for the tuning elements being transversal with regard to the longitudinal direction of the control rod.

9. A filter according to claim 6, the tuning elements being located in recesses formed in upper surface of the control rod.

10. A filter according to claim 2, motion direction of said tuning body being horizontal.

11. A filter according to claim 3, each tuning element being attached fixedly to said control rod through a hole in the filter lid, which hole is elongated to enable tuning motions.

12. A filter according to claim 3, wherein the tuning elements can be moved by a rotational motion.

13. A filter according to claim 12, wherein, for said rotational motion, each tuning element the tuning element is provided with a shaft locking to the lid of the housing by an axis of rotation, and said connecting to the control rod located outside the housing is implemented by an arm, the one end of which is fastened fixedly to the top of the axis of rotation and the other end of which is fastened by a shaft locking to the control rod.

14. A filter according to claim 2, being a transmitting or receiving filter of an integrated duplex filter, which transmitting and receiving filters each have a separate tuning body.

15. A filter according to claim 2, said tuning body being supported in notches, which are located at the top edges of the partition walls.

16. A filter according to claim 1, each tuning element having a substantially right-angled prismatic shape.

17. A filter according to claim 1, each tuning element being wedge-like as seen from a side in the direction perpendicular to its direction of motion.

18. A filter according to claim 1, each tuning element widening from one end to the other, as seen from above, to set a sensitivity of the tuning.

19. A filter according to claim 1, each tuning element comprising at least two parts so that the dielectric constants of the parts differ from each other.

* * * * *